US011686321B2

(12) United States Patent
Harris et al.

(10) Patent No.: US 11,686,321 B2
(45) Date of Patent: Jun. 27, 2023

(54) CEILING FAN HAVING DOUBLE-LAYER BLADES

(71) Applicant: AIR COOL INDUSTRIAL CO., LTD., Taichung (TW)

(72) Inventors: Joseph Warren Harris, Canton, GA (US); Tim Liu, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/523,792

(22) Filed: Nov. 10, 2021

(65) Prior Publication Data

US 2023/0143101 A1 May 11, 2023

(51) Int. Cl.

| | |
|---|---|
| ***F04D 29/34*** | (2006.01) |
| ***F04D 25/08*** | (2006.01) |
| ***F04D 29/38*** | (2006.01) |
| ***F04D 29/60*** | (2006.01) |

(52) U.S. Cl.

CPC ..... *F04D 29/34* (2013.01); *F04D 25/088* (2013.01); *F04D 29/384* (2013.01); *F04D 29/601* (2013.01)

(58) Field of Classification Search

CPC ..... F04D 29/34; F04D 25/088; F04D 29/384; F04D 29/601

USPC ..... 416/210 R

See application file for complete search history.

(56) References Cited

U.S. PATENT DOCUMENTS 5,330,323 A * 7/1994 Swanson ..... F04D 29/34 416/219 A
6,146,097 A * 11/2000 Bradt ..... F04D 25/088 416/169 R
7,481,626 B2 * 1/2009 Gajewski ..... F04D 29/384 416/220 A
D598,090 S * 8/2009 Pittman ..... F04D 25/088 D23/377
D670,802 S * 11/2012 Wang ..... D23/413
D671,203 S * 11/2012 Wang ..... D26/59
8,449,252 B2 * 5/2013 Van Otten Tolman ..... F04D 25/088 416/201 A
D715,419 S * 10/2014 Schulzman ..... D23/377
D715,421 S * 10/2014 Schulzman ..... D23/413
D721,430 S * 1/2015 Schulzman ..... D23/413
9,416,982 B2 * 8/2016 Kim ..... F24F 1/38
9,605,685 B2 * 3/2017 Wang ..... F04D 25/088
9,726,191 B2 * 8/2017 Wang ..... F04D 29/646
D800,292 S * 10/2017 Haggar ..... D23/385
9,995,305 B2 * 6/2018 Golm, Jr. ..... F04D 29/665
D828,915 S * 9/2018 Haggar ..... D23/413
10,202,981 B2 * 2/2019 Lin ..... F04D 17/025
(Continued)

*Primary Examiner* — Logan M Kraft
*Assistant Examiner* — John D Bailey
(74) *Attorney, Agent, or Firm* — Pai Patent & Trademark Law Firm; Chao-Chang David Pai

(57) ABSTRACT

A ceiling fan having double-layer blades includes a motor unit, a blade frame unit, a first blade unit, and a second blade unit. The blade frame unit has a blade frame body. The first blade unit includes a plurality of first blades. The second blade unit includes a plurality of second blades. The first blades and the second blades surround the outside of the blade frame body, so that there is no need for the motor unit to provide a motor housing for connecting the first blades and the second blades, thereby saving costs and installation costs. With the arrangement of the first blades and the second blades, the ceiling fan can increase the current of air for cooling.

7 Claims, 6 Drawing Sheets

(56) References Cited

U.S. PATENT DOCUMENTS 10,280,943 B2 * 5/2019 Tracy ..... F04D 29/325
10,428,831 B2 * 10/2019 Niemiec ..... F04D 25/06
D873,404 S * 1/2020 Biancuzzo ..... D23/377
D916,272 S * 4/2021 Gajewski ..... D23/413
D933,188 S * 10/2021 Li ..... D23/377
D933,810 S * 10/2021 Li ..... D23/413
2005/0249598 A1 * 11/2005 Young ..... F04D 19/024
416/198 R
2006/0024165 A1 * 2/2006 Gajewski ..... F04D 25/088
416/21 OR
2007/0104583 A1 * 5/2007 Gajewski ..... F04D 29/005
416/21 OR
2008/0213094 A1 * 9/2008 Okimura ..... F04D 25/088
416/5
2011/0020135 A1 * 1/2011 Itou ..... F04D 29/563
416/244 R
2011/0171021 A1 * 7/2011 VanOtten Tolman .....
F04D 19/024
416/128
2012/0045331 A1 * 2/2012 Villella ..... F04D 29/36
416/5
2012/0087796 A1 * 4/2012 McMahon ..... F04D 29/34
416/21 OR
2013/0101427 A1 * 4/2013 Chen ..... F04D 29/384
416/227 R
2014/0086729 A1 * 3/2014 Peery ..... F04D 29/052
415/119
2014/0119925 A1 * 5/2014 Wang ..... F04D 25/088
416/204 R
2015/0198175 A1 * 7/2015 Lin ..... F04D 29/34
416/212 R
2016/0131152 A1 * 5/2016 Wang ..... F04D 19/002
416/214 R
2016/0290357 A1 * 10/2016 Whitley ..... F04D 19/002
2016/0319843 A1 * 11/2016 Tracy ..... F04D 25/088
2017/0363106 A1 * 12/2017 Berean ..... F04D 19/002
2021/0115938 A1 * 4/2021 Chen ..... F21V 33/0096
2021/0317982 A1 * 10/2021 Shao ..... F21V 33/0096

* cited by examiner

CEILING FAN HAVING DOUBLE-LAYER BLADES

FIELD OF THE INVENTION

The present invention relates to a ceiling fan, and more particularly to a ceiling fan having double-layer blades.

BACKGROUND OF THE INVENTION

A conventional double-motor ceiling fan structure includes a ceiling fan body. Either side of the ceiling fan body is connected with a motor. Each motor has a motor housing. The motor housing is provided with a plurality of blade holders. Each blade holder is provided with a blade. The dual-motor ceiling fan structure is driven by the motors to rotate the corresponding blades. Compared with a single-motor ceiling fan, the dual-motor ceiling fan structure can generate greater current of air for cooling.

However, the above-mentioned dual-motor ceiling fan structure is not only complicated and cumbersome but also expensive. Another conventional dual-motor ceiling fan structure provides blades that are rotated reversely. This rotation will offset air current and cannot generate more wind volume. Accordingly, the inventor of the present invention has devoted himself based on his many years of practical experiences to solve these problems.

SUMMARY OF THE INVENTION

The primary object of the present invention is to provide a ceiling fan having double-layer blades, which increases the current of air for cooling and has the advantages of saving costs and installation costs.

In order to achieve the above object, the present invention provides a ceiling fan having double-layer blades. The ceiling fan comprises a motor unit, a blade frame unit, a first blade unit, and a second blade unit. The motor unit includes a motor. The motor has a rotating component. The blade frame unit has a blade frame body. The blade frame body is arranged on an outer peripheral side of the motor. The blade frame body is fixedly connected to the rotating component of the motor. An upper end of the blade frame body has an upper mounting portion. A lower end of the blade frame body has a lower mounting portion. The first blade unit includes a plurality of first blades. The first blades each have a first fixing portion, a first extension wall, and a first blade portion. The first fixing portions of the first blades are fixed to the upper mounting portion. The first extension wall and the first blade portion of each first blade are connected to each other. The first extension walls of the first blades extend axially along the blade frame body. The first extension walls of the first blades surround an outside of the blade frame body to collectively form a first casing. The first casing has a first accommodating space therein. The second blade unit includes a plurality of second blades. The second blades each have a second fixing portion, a second extension wall, and a second blade portion. The second fixing portions of the second blades are fixed to the lower mounting portion. The second extension wall and the second blade portion of each second blade are connected to each other. The second extension walls of the second blades extend axially along the blade frame body. The second extension walls of the second blades surround the outside of the blade frame body to collectively form a second casing. The second casing has a second accommodating space therein. The first accommodating space of the first casing and the second accommodating space of the second casing are configured to accommodate the blade frame body and the motor.

In the ceiling fan having double-layer blades provided by the present invention, the first casing formed by the first blades and the second casing formed by the second blades collectively surround the outside of the blade frame body, so that there is no need for the motor unit to provide a motor housing for connecting the first blade unit and the second blade unit, thereby saving costs and installation costs. With the multi-layer arrangement of the first blades of the first blade unit and the second blades of the second blade unit, the ceiling fan having double-layer blades can increase the current of air for cooling.

DETAILED DESCRIPTION OF THE PREFERRED EMBODIMENTS

Embodiments of the present invention will now be described, by way of example only, with reference to the accompanying drawings.

Figure 1:
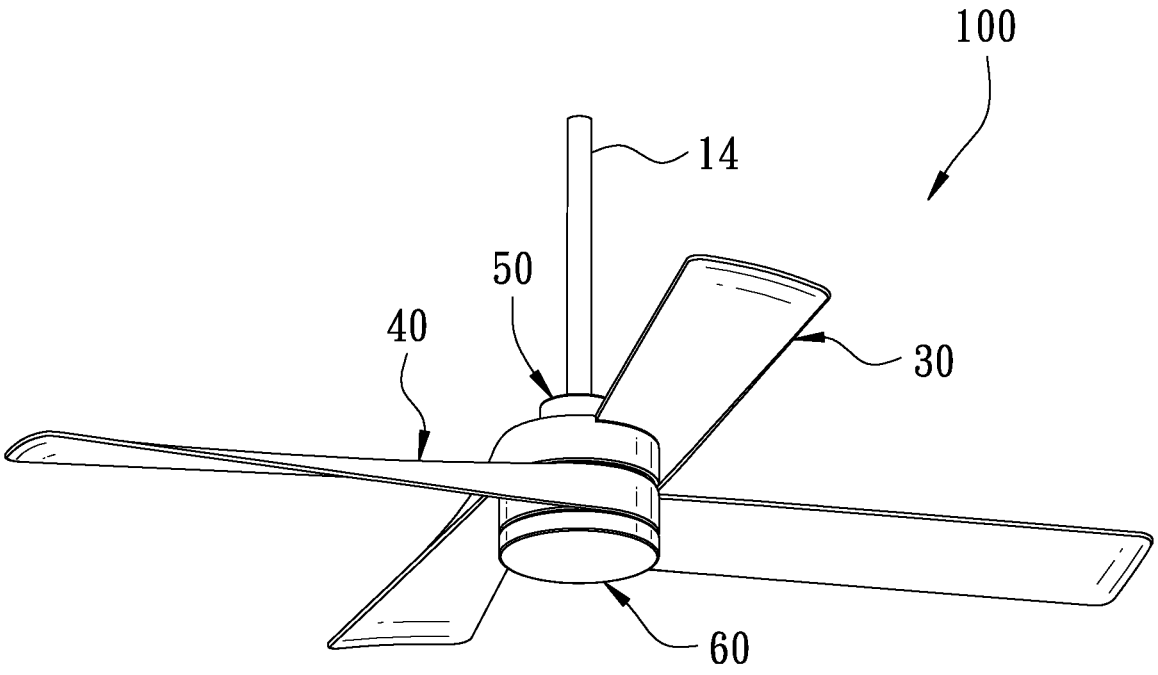
FIG. 1 is a perspective view of a preferred embodiment of the present invention.
Figure 2:
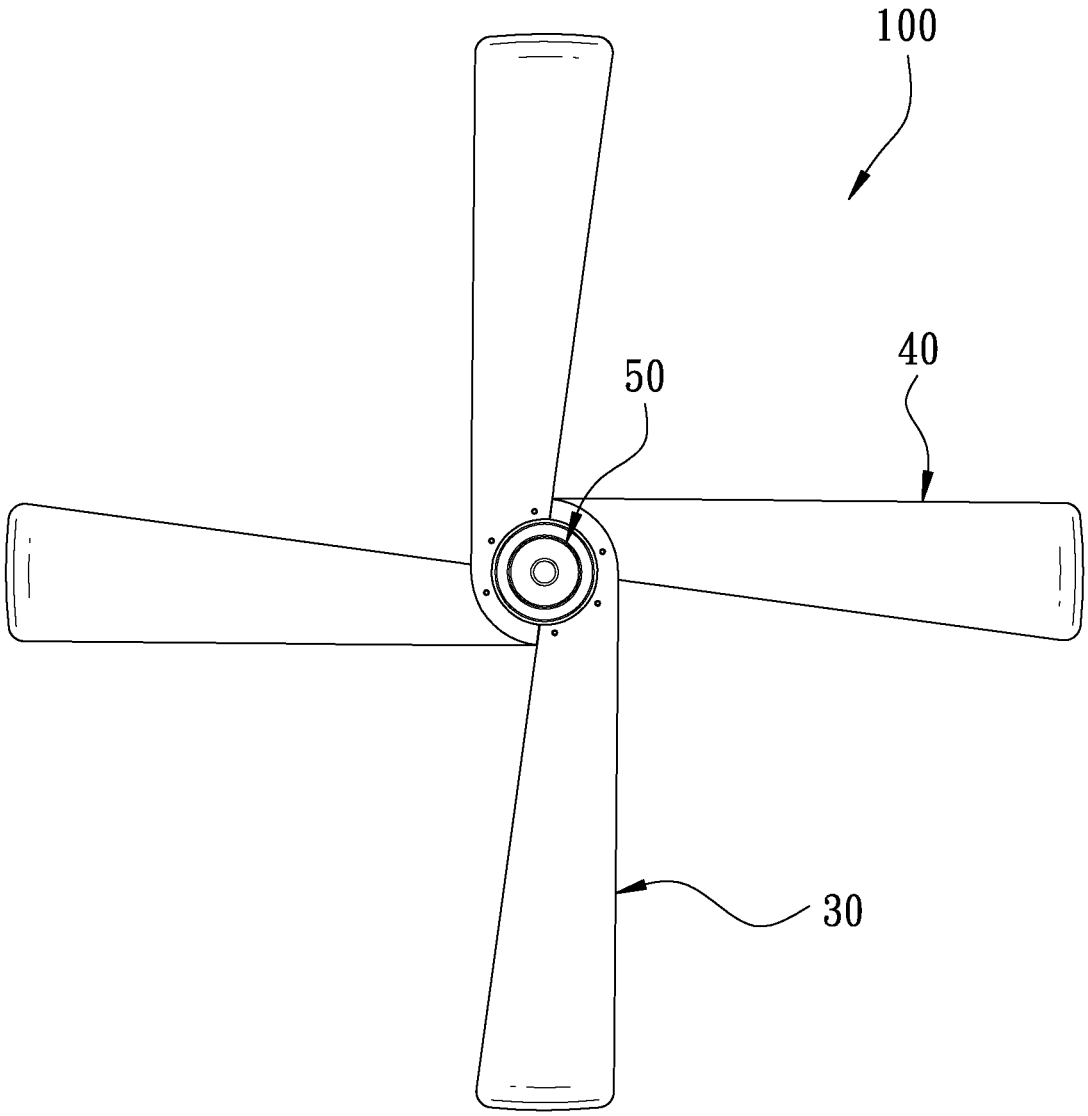
FIG. 2 is a top view of the preferred embodiment of the present invention.
Figure 3:
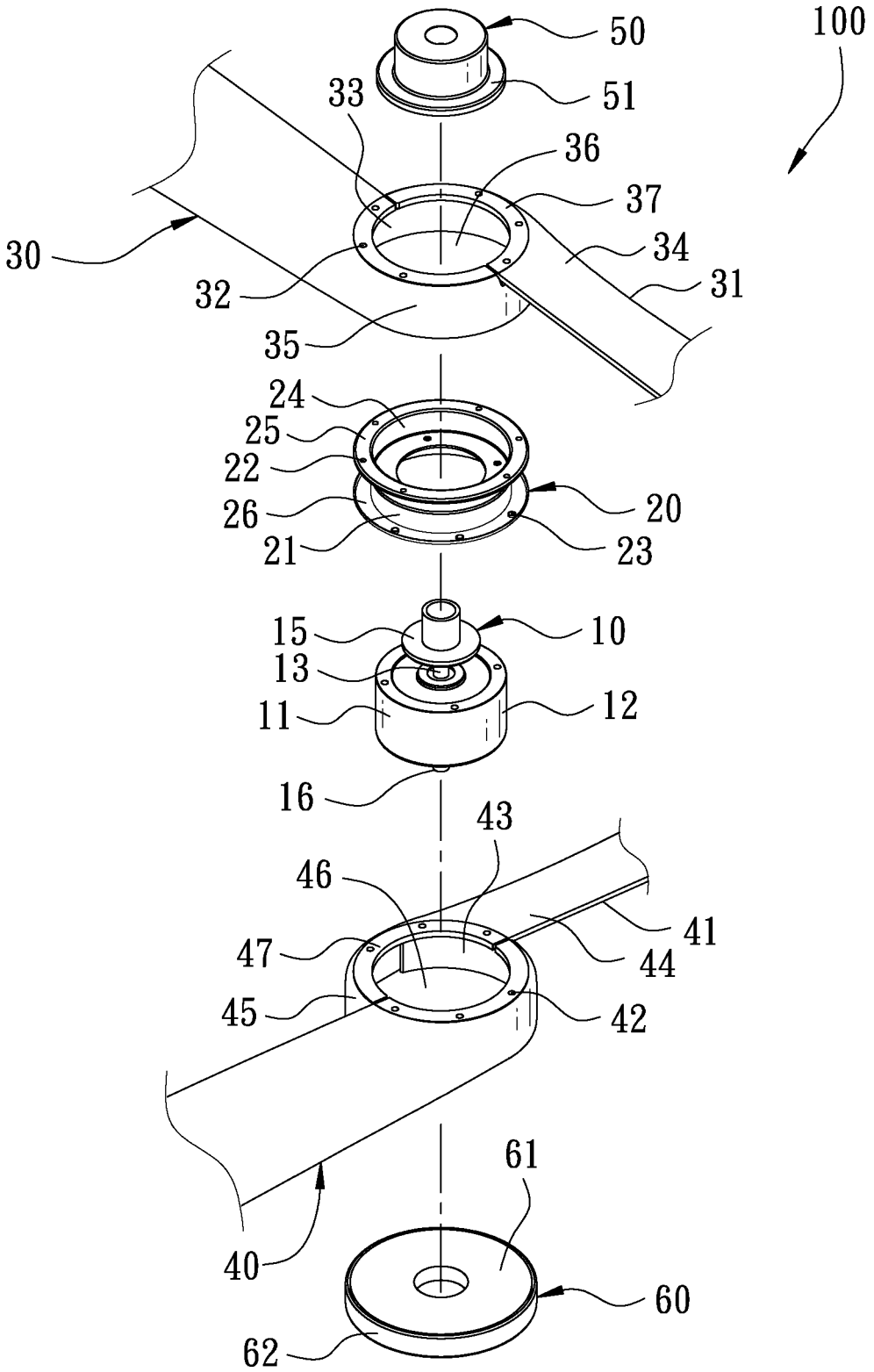
FIG. 3 is an exploded view of the preferred embodiment of the present invention.

FIG. 1 is a perspective view of a preferred embodiment of the present invention. FIG. 2 is a top view of the preferred embodiment of the present invention. FIG. 3 is an exploded view of the preferred embodiment of the present invention. The present invention discloses a ceiling fan 100 having double-layer blades, comprising a motor unit 10, a blade frame unit 20, a first blade unit 30, a second blade unit 40, an upper cover 50, and a lamp 60.

The motor unit 10 includes a motor 11. The motor 11 has a rotating component 12. An upper retaining portion 13 is fixedly connected to the top of the motor 11. The upper retaining portion 13 is fixedly connected to a down rod 14, so as to be fixed to the ceiling. The upper retaining portion 13 is fixedly connected to the down rod 14 through a connecting seat 15. A lower retaining portion 16 is fixedly connected to the bottom of the motor 11.

Figure 4:
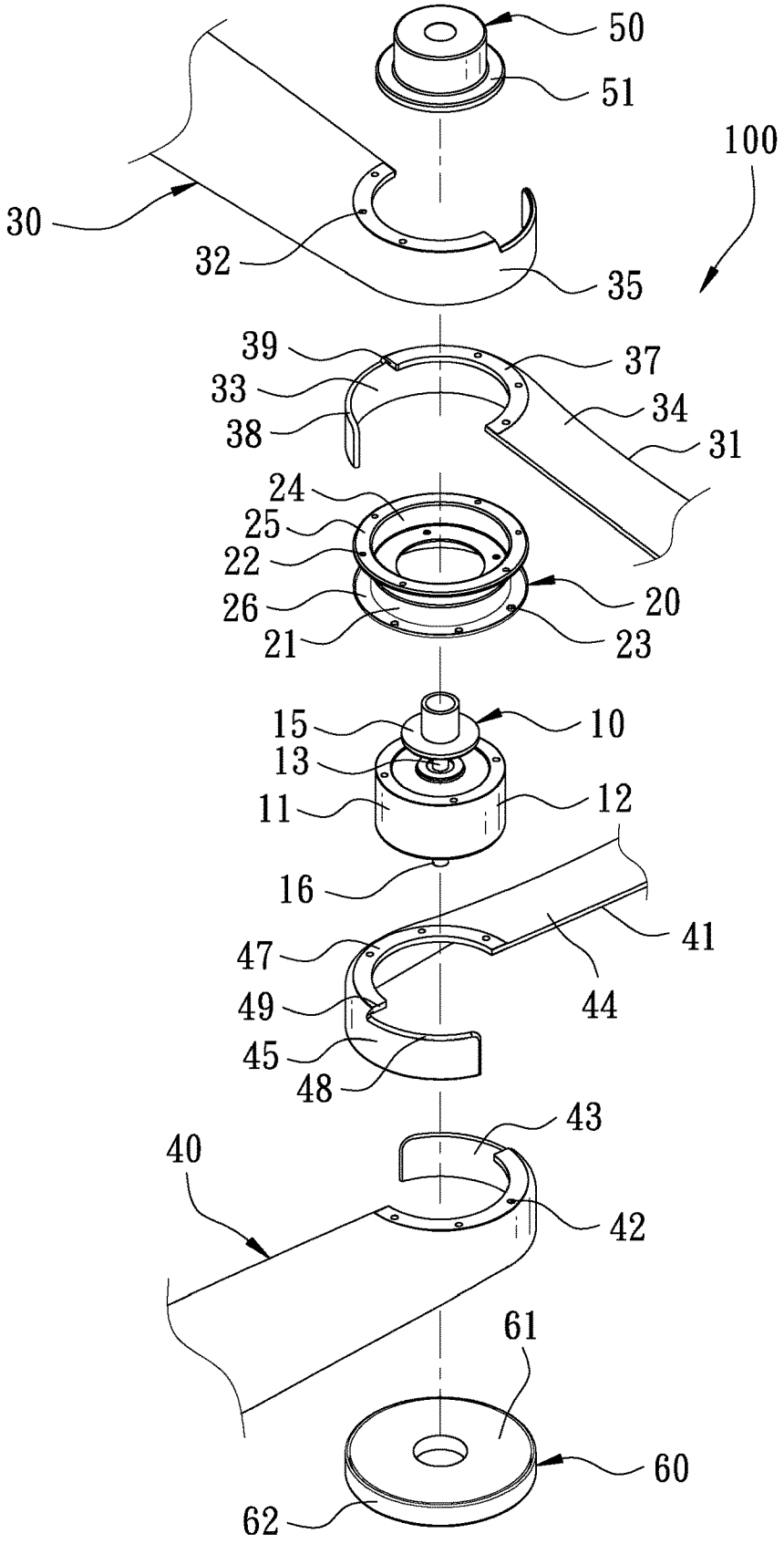
FIG. 4 is another exploded view of the preferred embodiment of the present invention.
Figure 5:
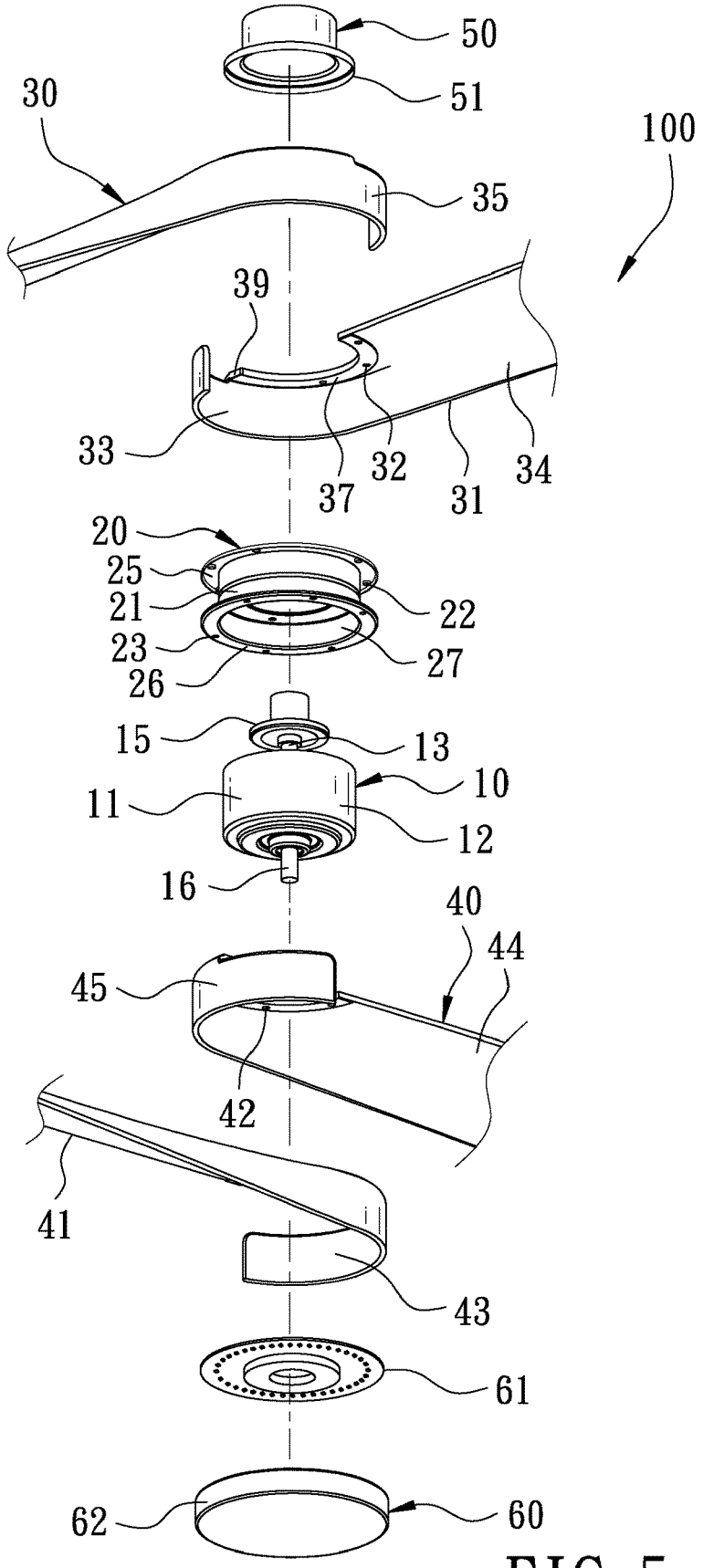
FIG. 5 is a further exploded view seen from the bottom of the preferred embodiment of the present invention.

FIG. 4 is another exploded view of the preferred embodiment of the present invention. FIG. 5 is a further exploded view seen from the bottom of the preferred embodiment of the present invention. The blade frame unit 20 has a blade frame body 21. The blade frame body 21 is arranged on the outer peripheral side of the motor 11. The blade frame body 21 is fixedly connected to the rotating component 12 of the motor 11. The upper end of the blade frame body 21 has an upper mounting portion 22. The upper mounting portion 22 may be composed of screw holes. The lower end of the blade frame body 21 has a lower mounting portion 23. The lower mounting portion 23 may be composed of screw holes. The blade frame body 21 has an annular wall 24. The top end of the annular wall 24 has an upper flange 25 extending radially and outwardly. The upper mounting portion 22 is disposed on the upper flange 25. The bottom end of the annular wall 24 has a lower flange 26 extending radially and outwardly. The lower mounting portion 23 is disposed on the lower flange 26. A motor mounting portion 27 extends from the inner side of the annular wall 24 toward the axis. The rotating component 12 of the motor 11 is connected to the motor mounting portion 27.

The first blade unit 30 includes a plurality of first blades 31. The first blades 31 each have a first fixing portion 32, a first extension wall 33, and a first blade portion 34. The first fixing portions 32 of the first blades 31 are fixed to the upper mounting portion 22. The first fixing portions 32 of the first blades 31 may be composed of screw holes, and are locked to the upper mounting portion 22 with screws. The first extension wall 33 and the first blade portion 34 of each first blade 31 are connected to each other. The first extension walls 33 of the first blades 31 extend axially along the blade frame body 21. The first extension walls 33 of the first blades 31 surround the outside of the blade frame body 21 to collectively form a first casing 35. The first casing 35 has a first accommodating space 36 therein. One side of the top of the first extension wall 33 of each first blade 31, adjacent to the first blade portion 34, and the first blade portion 34 have a first inner arc portion 37 extending toward the axis of the blade frame body 21. The first inner arc portions 37 are arranged on top of the upper flange 25 so that the upper flange 25 supports the first inner arc portions 37. The first fixing portions 32 of the first blades 31 are disposed on the first inner arc portions 37, respectively. The other side of the top of the first extension wall 33 of each first blade 31, opposite to the first blade portion 34, is formed with a first edge 38. The first edge 38 of each first blade 31 is lower than the first inner arc portion 37. Each first edge 38 corresponds to the first inner arc portion 37 of the coupled first blade 31 for the first inner arc portion 37 of the coupled first blade 31 to pass therethough. One side of the first inner arc portion 37 of each first blade 31, adjacent to the first edge 38, is provided with a first abutting surface 39 to abut against the first inner arc portion 37 of the coupled first blade 31.

The second blade unit 40 includes a plurality of second blades 41. The second blades 41 each have a second fixing portion 42, a second extension wall 43, and a second blade portion 44. The second fixing portions 42 of the second blades 41 are fixed to the lower mounting portion 23. The second fixing portions 42 of the second blades 41 may be composed of screw holes, and are locked to the lower mounting portion 23 with screws. The second extension walls 43 of the second blades 41 are adjacent to and beneath the first extension walls 33 of the first blades 31. The second extension wall 43 and the second blade portion 44 of each second blade 41 are connected to each other. The second extension walls 43 of the second blades 41 extend axially along the blade frame body 21. The second extension walls 43 of the second blades 41 surround the outside of the blade frame body 21 to collectively form a second casing 45. The second casing 45 has a second accommodating space 46 therein. The first accommodating space 36 of the first casing 35 and the second accommodating space 46 of the second casing 45 are configured to accommodate the blade frame body 21 and the motor 11. One side of the top of the second extension wall 43 of each second blade 41, adjacent to the second blade portion 44, and the second blade portion 44 have a second inner arc portion 47 extending toward the axis of the blade frame body 21. The second inner arc portions 47 are arranged on top of the lower flange 26 so that the lower flange 26 supports the second inner arc portions 47. The second fixing portions 42 of the second blades 41 are disposed on the second inner arc portions 47, respectively. The other side of the top of the second extension wall 43 of each second blade 41, opposite to the second blade portion 44, is formed with a second edge 48. The second edge 48 of each second blade 41 is lower than the second inner arc portion 47. Each second edge 48 corresponds to the second inner arc portion 47 of the coupled second blade 41 for the second inner arc portion 47 of the coupled second blade 41 to pass therethough. One side of the second inner arc portion 47 of each second blade 41, adjacent to the second edge 48, is provided with a second abutting surface 49 to abut against the second inner arc portion 47 of the coupled second blade 41. In this embodiment of the present invention, the first blade portions 34 of the first blades 31 and the second blade portions 44 of the second blades 41 are arranged crosswise.

The upper cover 50 is disposed on the outside of the connecting seat 15. The upper cover 50 is located above the blade frame body 21. The down rod 14 is inserted through the upper cover 50. The upper cover 50 has a flange 51. The flange 51 of the upper cover 50 is located between the first inner arc portions 37 of the first blades 31.

The lamp 60 has a lamp module 61 and a lampshade 62. The lamp module 61 is fixedly connected to the lower retaining portion 16. The lampshade 62 is fixed to the outside of the lamp module 61 and located under the second extension walls 43 of the second blades 41.

Figure 6:
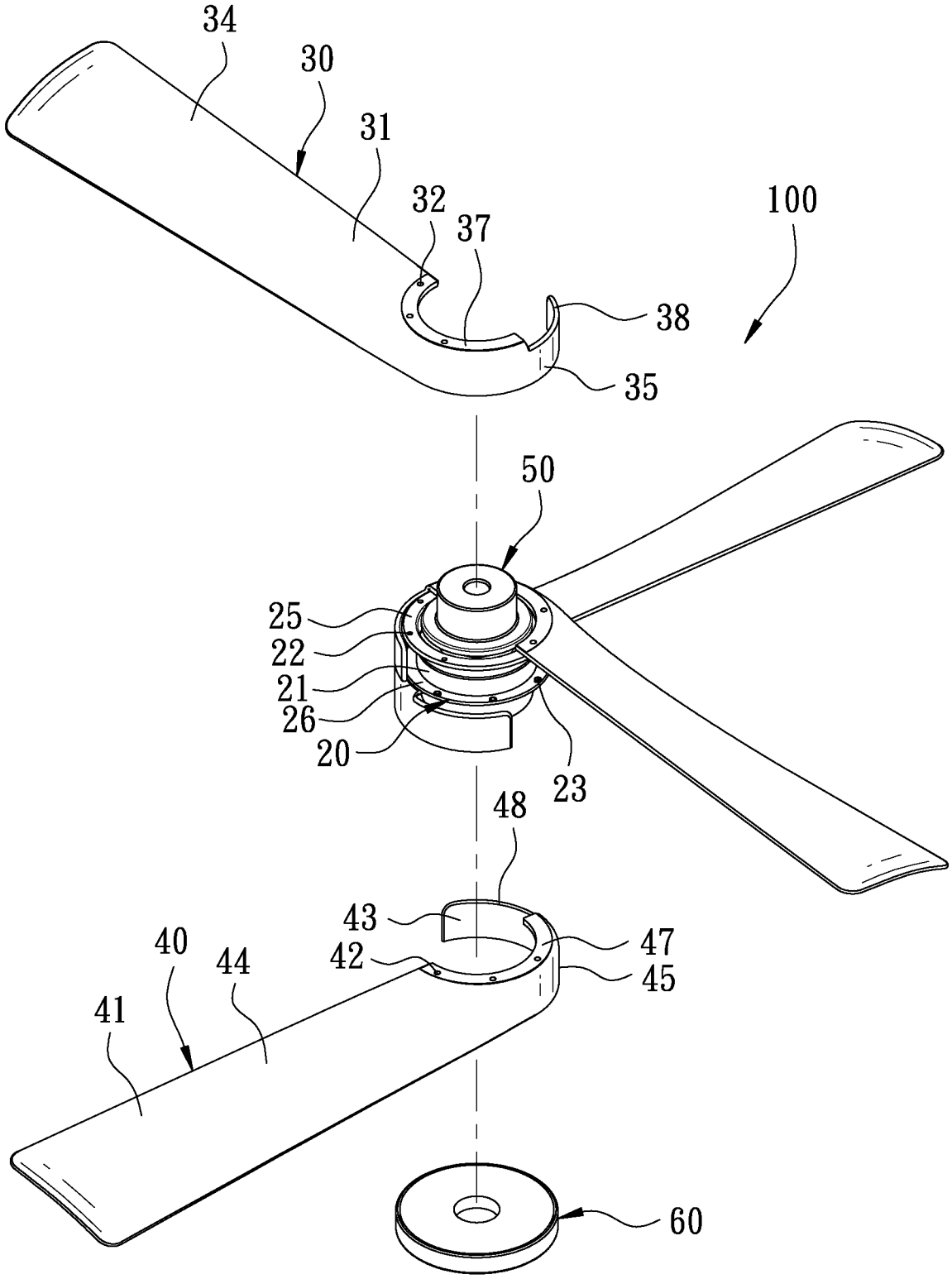
FIG. 6 is a schematic view showing the installation of the preferred embodiment of the present invention.

FIG. 6 is a schematic view showing the installation of the preferred embodiment of the present invention. When the ceiling fan 100 having double-layer blades is to be assembled, the first fixing portions 32 of the first blades 31 are first aligned with the upper mounting portion 22 of the blade frame body 21, and the second fixing portions 42 of the second blades 41 are aligned with the lower mounting portion 23 of the blade frame body 21. The first abutting surface 39 of each first blade 31 abuts against the first inner arc portion 37 of the coupled first blade 31. The second abutting surface 49 of each second blade 41 abuts against the second inner arc portion 47 of the coupled second blade 41. The first extension wall 33 of each first blade 31 abuts against the first extension wall 33 of the coupled first blade 31. The second extension wall 43 of each second blade 41 abuts against the second extension wall 43 of the coupled second blade 41. The first fixing portions 32 of the first blades 31 are locked to the upper mounting portion 22 by screws, respectively. The second fixing portions 42 of the second blades 41 are locked to the lower mounting portion 23 by screws, respectively. The first casing 35 formed by the first blades 31 and the second casing 45 formed by the second blades 41 collectively surround the outside of the blade frame body 21. The blade frame body 21 is accommodated in the first accommodating space 36 and the second accommodating space 46 to quickly complete the assembly of the ceiling fan 100 with double-layer blades.

It is worth mentioning that in the ceiling fan 100 having double-layer blades of the present invention, the first casing 35 formed by the first blades 31 and the second casing 45 formed by the second blades 41 collectively surround the outside of the blade frame body 21, so that there is no need for the motor unit 10 to provide a motor housing for connecting the first blade unit 30 and the second blade unit 40, thereby saving costs and installation costs. With the multi-layer arrangement of the first blades 31 of the first blade unit 30 and the second blades 41 of the second blade unit 40, the ceiling fan 100 having double-layer blades can increase the current of air for cooling.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan, comprising:

a motor unit, including a motor, the motor having a rotating component;

a blade frame unit, having a blade frame body, the blade frame body being arranged on an outer peripheral side of the motor, the blade frame body being fixedly connected to the rotating component of the motor, an upper end of the blade frame body having an upper mounting portion, a lower end of the blade frame body having a lower mounting portion;

a first blade unit, including a plurality of first blades, the first blades each having a first fixing portion, a first extension wall and a first blade portion, the first fixing portions of the first blades being fixed to the upper mounting portion, the first extension wall and the first blade portion of each first blade being connected to each other, the first extension walls of the first blades extending axially along the blade frame body, the first extension walls of the first blades surrounding an outside of the blade frame body to collectively form a first casing, the first casing having a first accommodating space therein; and a second blade unit, including a plurality of second blades, the second blades each having a second fixing portion, a second extension wall and a second blade portion, the second fixing portions of the second blades being fixed to the lower mounting portion, the second extension wall and the second blade portion of each second blade being connected to each other, the second extension walls of the second blades extending axially along the blade frame body, the second extension walls of the second blades surrounding the outside of the blade frame body to collectively form a second casing, the second casing having a second accommodating space therein, the first accommodating space of the first casing and the second accommodating space of the second casing being configured to accommodate the blade frame body and the motor, wherein the second extension walls of the second blades are adjacent to and beneath the first extension walls of the first blades;

one side of a top of the first extension wall of each first blade, adjacent to the first blade portion, and the first blade portion have a first inner arc portion extending toward an axis of the blade frame body, the first fixing portions of the first blades are disposed on the first inner arc portions respectively, another side of the top of the first extension wall of each first blade, opposite to the first blade portion, is formed with a first edge, the first edge of each first blade is lower than the first inner arc portion, each first edge corresponds to the first inner arc portion of a coupled one of the first blades for the first inner arc portion of the coupled first blade to pass therethough, one side of the first inner arc portion of each first blade, adjacent to the first edge, is provided with a first abutting surface to abut against the first inner arc portion of the coupled first blade; and one side of a top of the second extension wall of each second blade, adjacent to the second blade portion, and the second blade portion have a second inner arc portion extending toward the axis of the blade frame body, the second fixing portions of the second blades are disposed on the second inner arc portions respectively, another side of the top of the second extension wall of each second blade, opposite to the second blade portion, is formed with a second edge, the second edge of each second blade is lower than the second inner arc portion, each second edge corresponds to the second inner arc portion of a coupled one of the second blades for the second inner arc portion of the coupled second blade to pass therethough, and one side of the second inner arc portion of each second blade, adjacent to the second edge, is provided with a second abutting surface to abut against the second inner arc portion of the coupled second blade.

2. The ceiling fan as claimed in claim 1, wherein the blade frame body has an annular wall, a top end of the annular wall has an upper flange extending radially and outwardly, the upper mounting portion is disposed on the upper flange, the first inner arc portions are arranged on top of the upper flange so that the upper flange supports the first inner arc portions, a bottom end of the annular wall has a lower flange extending radially and outwardly, the lower mounting portion is disposed on the lower flange, the second inner arc portions are arranged on top of the lower flange so that the lower flange supports the second inner arc portions, a motor mounting portion extends from an inner side of the annular wall toward the axis, and the rotating component of the motor is connected to the motor mounting portion.

3. The ceiling fan as claimed in claim 2, wherein an upper retaining portion is fixedly connected to a top of the motor, the upper retaining portion is fixedly connected to a down rod to be fixed to a ceiling, the ceiling fan further comprises an upper cover, the down rod is inserted through the upper cover, the upper cover is located between the first inner arc portions of the first blades, a lower retaining portion is fixedly connected to a bottom of the motor, the ceiling fan further comprises a lamp, the lamp has a lamp module and a lampshade, the lamp module is fixedly connected to the lower retaining portion, and the lampshade is fixed to an outside of the lamp module and located under the second extension walls of the second blades.

4. The ceiling fan as claimed in claim 3, wherein the first blade portions of the first blades and the second blade portions of the second blades are arranged crosswise, the upper retaining portion is fixedly connected to the down rod through a connecting seat, the upper cover is disposed on an outside of the connecting seat, and the upper cover is located above the blade frame body.

5. The ceiling fan as claimed in claim 4, wherein the upper mounting portion and the first fixing portions of the first blades are composed of screw holes and are locked with screws; the lower mounting portion and the second fixing portions of the second blades are composed of screw holes and are locked with screws.

6. The ceiling fan as claimed in claim 2, wherein the first blade portions of the first blades and the second blade portions of the second blades are arranged crosswise.

7. The ceiling fan as claimed in claim 1, wherein the first blade portions of the first blades and the second blade portions of the second blades are arranged crosswise.

* * * * *